US005836045A

United States Patent [19]

Anthony et al.

[11] Patent Number: 5,836,045

[45] Date of Patent: Nov. 17, 1998

[54] VACUUM CLEANER METHOD

[75] Inventors: Philip M. Anthony, Chicago; James C. Hand, Glen Ellyn; David Pacchini, Chicago, all of Ill.

[73] Assignee: Breuer Electric Mfg. Co., Chicago, Ill.

[21] Appl. No.: 863,808

[22] Filed: May 27, 1997

Related U.S. Application Data

[62] Division of Ser. No. 606,432, Feb. 23, 1996, Pat. No. 5,659,918.

[51] Int. Cl.[6] ..... A47L 11/30

[52] U.S. Cl. ..... 15/320; 15/353

[58] Field of Search ..... 15/320, 353

[56] References Cited

U.S. PATENT DOCUMENTS

| | | | |
|---|---|---|---|
| 3,060,484 | 10/1962 | Krammes | 15/320 |
| 3,402,420 | 9/1968 | Schaeffer | 15/320 |
| 4,156,952 | 6/1979 | Lynch | 15/320 |
| 4,196,492 | 4/1980 | Johnson et al. | 15/320 |
| 4,333,202 | 6/1982 | Block | 15/320 |
| 4,956,891 | 9/1990 | Wulff | 15/320 |
| 5,455,982 | 10/1995 | Armstrong et al. | 15/320 |

*Primary Examiner*—Chris K. Moore
*Attorney, Agent, or Firm*—Jack E. Dominik

[57] ABSTRACT

Disclosed is a wet/dry carpet cleaner having a large tank assembly for fluids. A bladder containing fresh or cleaning water is positioned in the large tank. Nozzles for dispensing the cleaning water to a brush, a vacuum nozzle for vacuuming and returning soiled fluid to the recovery tank portion of the tank assembly is also provided. The present invention includes the method of securing a brush head assembly pivotably to the chassis assembly and includes the driving motor, rotating brush, and spray mechanism. The pivotal securement results in the weight of the brush head assembly applying a constant force on the brush throughout the entire cleaning cycle, independent of the amount of fluid contained in the recovery tank or the bladder. Also, the method is addressed to configuring and proportioning the bladder to insure a relatively constant load on the nozzle. By balancing the nozzle loading and, therefore, the downward pressure per square inch on the nozzle throughout the cycle compensation results for fluid loss or fluid re-distribution. With the brush loading remaining constant throughout the cycle, consistency is maintained during the entire period while the carpet is being cleaned.

2 Claims, 9 Drawing Sheets

VACUUM CLEANER METHOD

CROSS-REFERENCE TO RELATED APPLICATION

The present application is a Rule 60 division application of Ser. No. 08/606,432, filed Feb. 23, 1996, now U.S. Pat. No. 5,659,918, issued Aug. 26, 1997.

FIELD OF THE INVENTION

The present invention is directed to commercial-type vacuum cleaners of the type generally found in U.S. patent Classes 15/330; 15/331; and 15/355.

SUMMARY OF THE PRIOR ART

The present invention is directed to the general field of commercial-type carpet cleaners, and more particularly the wet/dry type. With such units, normally there is a supply of fresh cleaning fluid which is basically water and which may contain cleaning solutions, a means for spraying the same on the carpet, and a means thereafter for brushing or agitating the same, and finally, a means for removing the same from the carpet in the form of a soiled water vacuum nozzle. In addition, particularly as exemplified by U.S. Pat. No. 4,956,891, issued Sep. 18, 1990, some such units attempt to balance the load of the fresh fluid and the recovered fluid for varying purposes.

The problem with the prior art such as exemplified in U.S. Pat. No. 4,956,891 is that it fails to address two areas which are important to carpet cleaning: consistent loading of the agitating brush, and consistent loading of the vacuum nozzle. If one is out of balance with the other, "striping" can occur where the various patches that are being cleaned by the operator are cleaned to varying degrees. Stated another way, in a large room, whether it is 60% cleaned of dirt and water, 70% cleaned of dirt and water, or 80% cleaned of dirt and water, if certain areas are cleaned 60% and others 80% an unsightly patchwork pattern can develop. Moreover, any such inconsistencies result in inconsistent drying of the carpet. Accordingly, what is needed is a commercial wet/dry carpet vacuum cleaner in which there is a consistency of the load on the brush agitating the carpet, and at the same time a consistent loading of the nozzle. This becomes even more delicate inasmuch as there may be a normal loss of 20% to 40% of the total fluid during the course of a cleaning cycle. As a result, with a typical eight gallon unit, and water weighing 8.3 pounds per gallon, the total fluid beginning weight is about 66.4 pounds. As much as ten to twenty-five pounds of fluid can be lost and not recovered during the cleaning cycle. Thus, if the weight of the water is being used to control the weight on the brush, the weight on the brush can be reduced by as much as 20% between the beginning of the cleaning and the end. Alternatively, if no consideration is paid to the weight of the unit and its contained fluid on the nozzle, the weight on the nozzle can be similarly varied as much as 20%. The combined inconsistencies of brush loading and nozzle loading invariably will lead to inconsistent degrees of cleansing and spent water recovery.

SUMMARY OF THE INVENTION

The present invention is addressed to a wet/dry carpet cleaner having a large tank assembly for fluids. A bladder containing fresh or cleaning water is positioned in the large tank. Means for dispensing the cleaning water to a brush, and then vacuuming the same and returning the soiled fluid to the recovery tank portion of the tank assembly are also provided. The present invention stems from the development of a brush head assembly which is pivotally secured to the chassis assembly and includes the driving motor, rotating brush, and spray mechanism. The pivotal securement results in the weight of the brush head assembly applying a constant force on the brush throughout the entire cleaning cycle, independent of the amount of fluid contained in the recovery tank or the bladder. Secondarily, the present invention is addressed to configurating and proportioning the bladder to insure a relatively constant load on the nozzle. By balancing the nozzle loading and, therefore, the downward pressure per square inch on the nozzle throughout the cycle to compensate for fluid loss or fluid re-distribution; with the brush loading remaining constant throughout the cycle, consistency is maintained during the entire period while the carpet is being cleaned.

In view of the foregoing it is a principle object of the present invention to devise a vacuum carpet cleaner of the wet/dry variety for carpets in which consistency of agitation of the carpet and its nap as well as consistency of the vacuum withdrawal of soiled solution are sought. In so doing a consistent pattern of cleaning is achieved in a large carpeted area when it is treated by one vacuum cleaner which, during the cleaning cycle, can lose 20% to 40% of its contained fluid.

Another and related object of the present invention is to provide a wet/dry vacuum carpet cleaner with an inner container for containing the fresh water located inside a tank for receiving the soiled water in which the cost of construction is essentially the same as that of the prior art and more particularly as exemplified in U.S. Pat. No. 4,956,891, issued Sep. 18, 1990.

Yet another object of the present invention is to provide a vacuum cleaner of the wet/dry variety which is easy to use by the operator, and wherein the operator does not have to adjust the load on the brush or the load on the vacuum nozzle during any portion of the cleaning cycle front beginning to end.

Still a further object of the present invention is to provide a wet/dry vacuum carpet cleaner which permits easy retraction of its brush head assembly to the end that when there is a pause in usage, or storage overnight, the brush can be raised from the carpet to prevent permanent deformation and other problems occurring with the relationship between the brush and the supporting surface.

BRIEF DESCRIPTION OF THE ILLUSTRATIVE DRAWINGS

Further objects and advantages of the present invention will become apparent as the following description of an illustrative embodiment takes place in conjunction with the accompanying drawings, in which.

DESCRIPTION OF A PREFERRED EMBODIMENT

Figure 1:
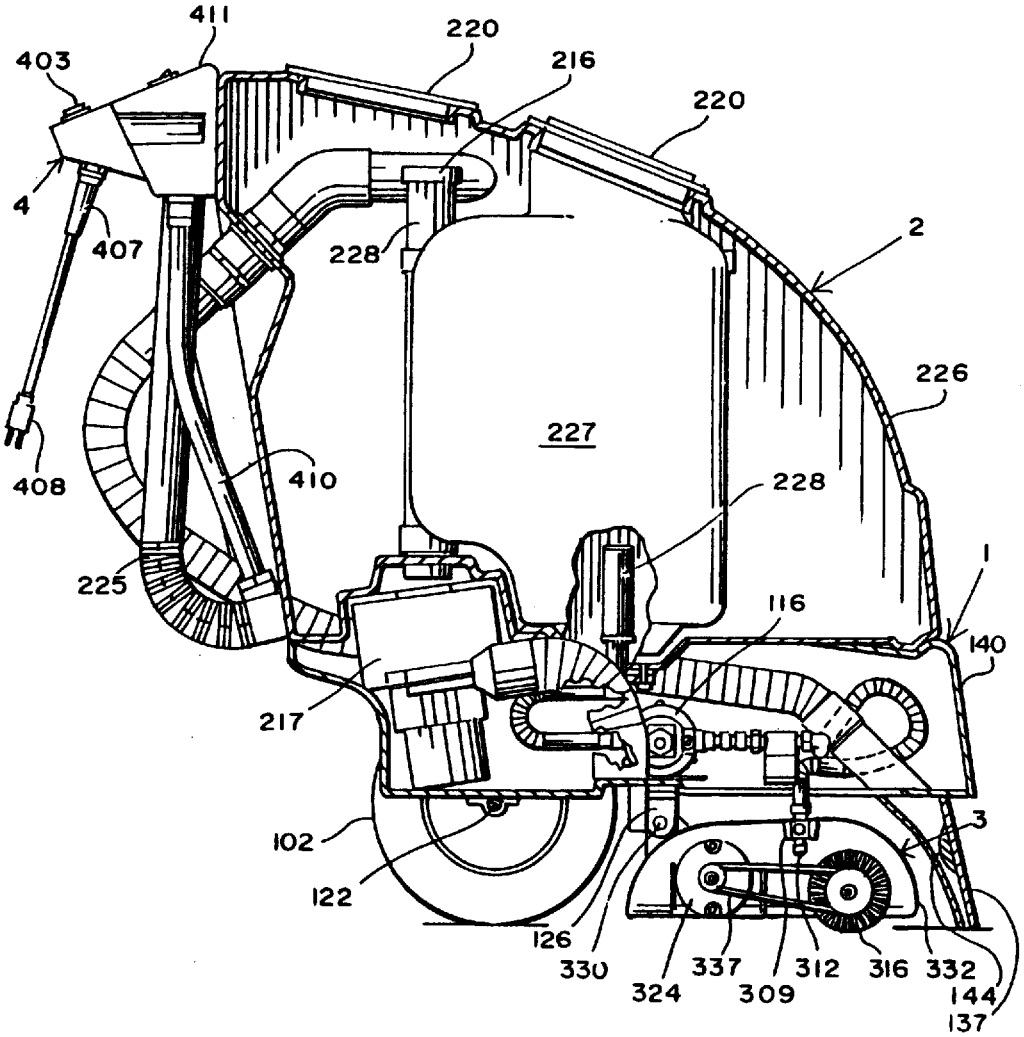
FIG. 1 is a side elevation partially broken and sectioned of the cleaner.
Figure 2:
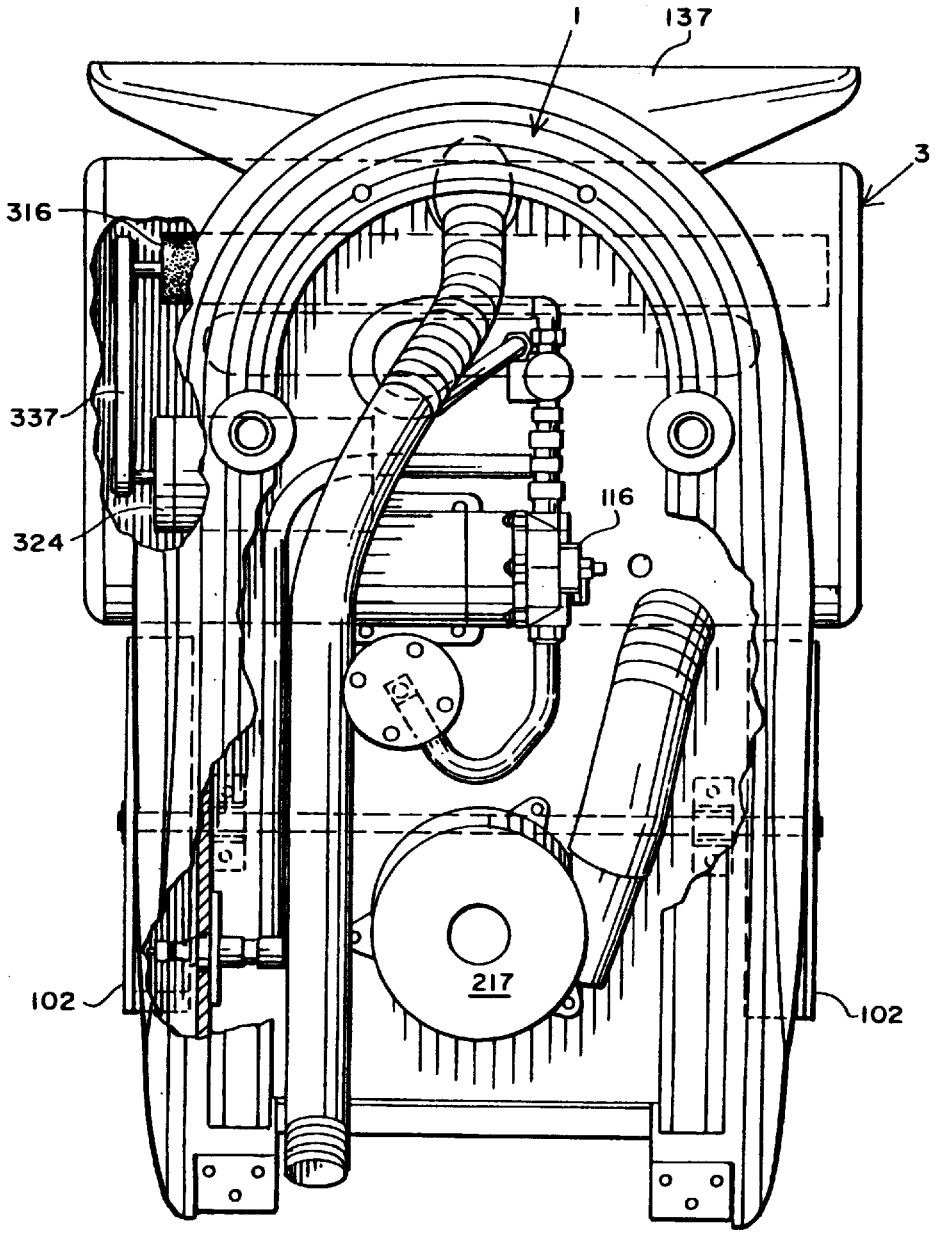
FIG. 2 is a top view partially broken of the cleaner in the same scale as FIG. 1.
Figure 3:
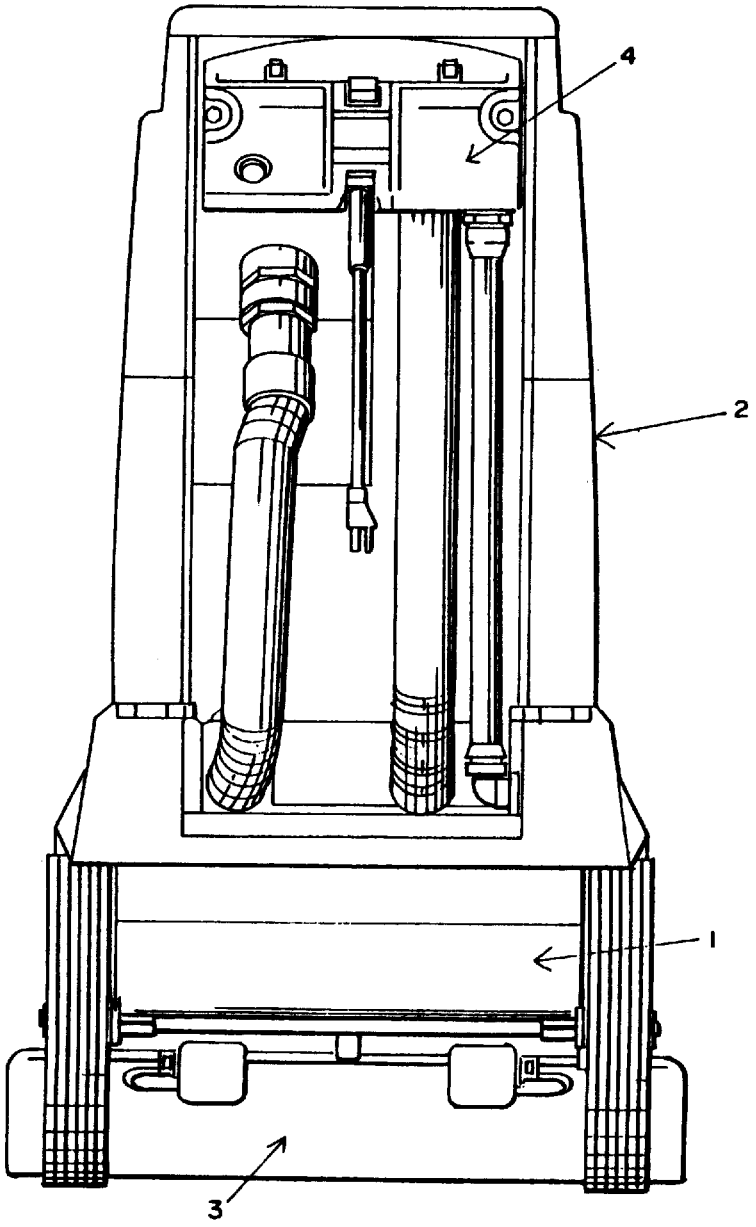
FIG. 3 is a rear view of the cleaner showing only the exterior portions.

As will be noted in FIG. 1, the present invention relates to a carpet cleaner. The carpet cleaner basically breaks down into a chassis assembly 1, a tank assembly 2 which fits on top of the chassis assembly 1, a pivoted brush head assembly 3 which is pivotally secured to the underneath forward portion of the chassis assembly, and a control panel assembly 4 which is secured to the upper portion of the unit opposite the vacuum nozzle with the wheels beneath the chassis and between the handle and the brush head assembly 3.

Each of the assemblies will be taken up separately with separate reference numerals applied to the drawings. The key to the reference numerals will be the series of one hundreds, from 100 through 400. For example, the chassis assembly uses the reference numerals in the 100 series, the tank assembly 200, the pivoted brush and spray head assembly 300, and the control panel assembly 400.

Figure 4:
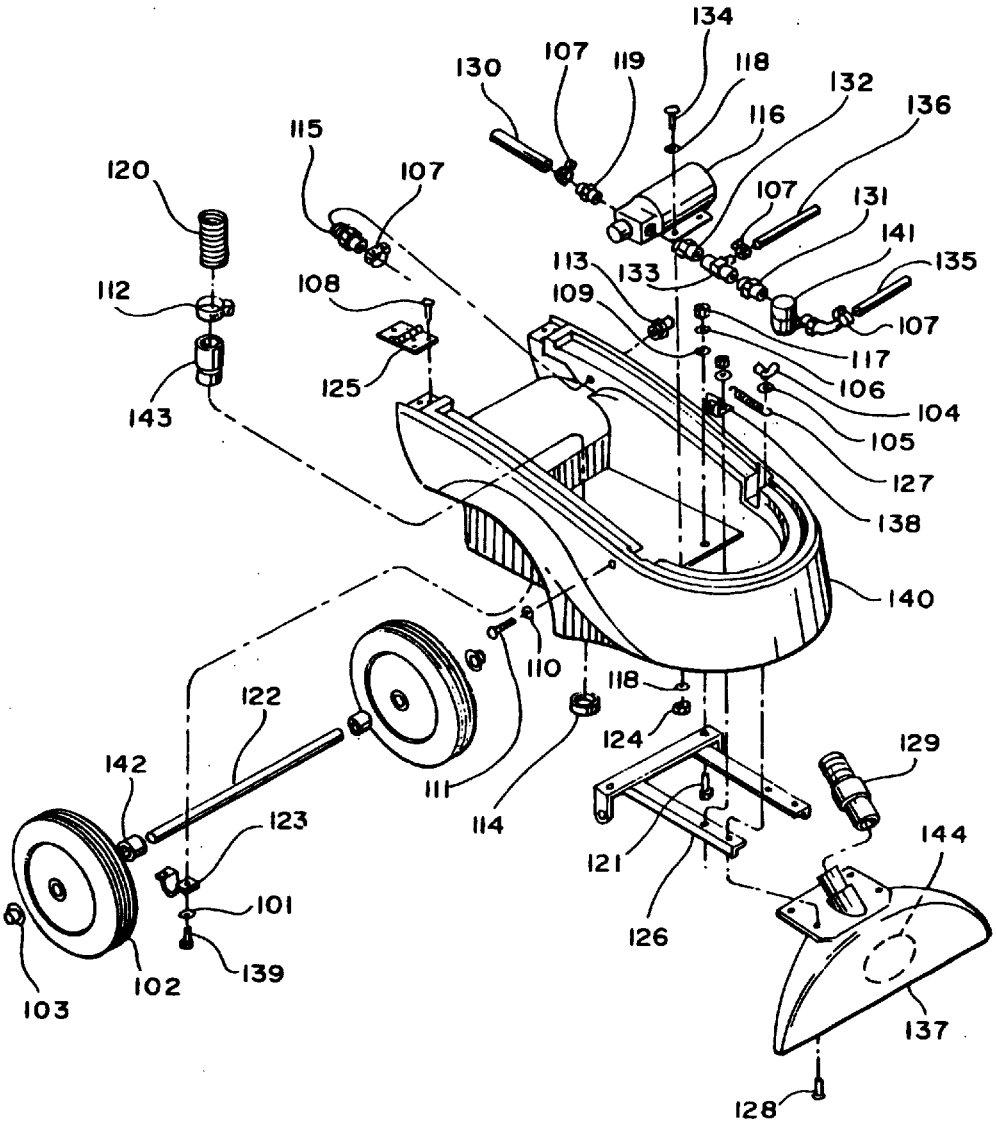
FIG. 4 is an exploded perspective view of the chassis assembly.

The principal elements of the chassis assembly 1 as shown in FIG. 4 are the wheels 102, the axle 122, the chassis 140, the vacuum nozzle 137, and the pump 116. Also important are the hinges 125 which secure and pivot the tank assembly 2 to the chassis assembly 1. More specifically, washers 101 cooperate with the wheel 102 and the retaining ring 103 to secure the wheel 102 by means of the spacer 142 to the axle 122. The retaining clamp 123 secures the axle 122 to the chassis assembly 140. Nuts 124, washers 118, and bolts 134 secure the pump 116 to the chassis 140.

Additionally, the fitting 113 threads onto fitting 115 through the wall of the chassis 140. Fitting 115 in turn secures to hose 136 by means of hose clamp 107. Hose 136 secures to fitting 133 by means of hose clamp 107. Fitting 133 secures in turn to fittings 132 and 131. Fitting 132 in turn connects to the water pump 116. Fitting 131 secures in turn to solenoid valve 141. Water pump 116 is plumbed to the bladder 227 depicted in FIG. 5 by means of fitting 119, hose clamps 107, and hose 130 depicted in FIG. 4 and fitting 208, plate 223, and fitting 222 depicted in FIG. 5. Plate 223 secures the bottom flange of bladder 227 to the bottom of tank 226 by means of bolts 210, lock washers 201 and washers 213. Additionally, solenoid valve 141 in FIG. 4 is plumbed to the spray jets 312 in FIG. 6 by means of hose 135 and hose clamp 107 in FIG. 4 and fitting 325 and manifold 309 in FIG. 6.

Referring back to FIG. 4, vacuum motor exhaust hose 120 is secured to chassis 140 by means of hose clamp 112, fitting 143 and fitting 114. Bolts 121 secure the shroud nozzle mounting bracket 126 to the chassis 140 by means of washers 109, lock washers 106 and nuts 117. The vacuum nozzle 137 secures between the bracket 126 and the chassis 140 by means of bolts 128. Vacuum nozzle 137 is connected to tank 226 in FIG. 5 by means of vacuum hose assembly 129 in FIG. 4 and fittings 238, 137, 236, 207, and 204, washer 214, rubber washer 203, fitting 206 and intake deflector 235 depicted in FIG. 5. Intake deflector 235 in FIG. 5 materially assists in reducing and dispersing foam.

Referring back to FIG. 4, hinges 125 are secured to the chassis 140 by means of screws 108. Further, extension spring 127 coordinates with plate 138 in FIG. 4 and lever 328 in FIG. 6 to secure the brush head and spray assembly 3 in FIG. 1 in the retracted position for transportation and storage.

In a typical installation the outside width of the nozzle at the end where it touches the floor ranges from fifteen to twenty inches. The dimensions of the nozzle opening at the end where it touches the floor are 0.21" to 0.25" deep by 15.50" to 19.50" wide.

Figure 5:
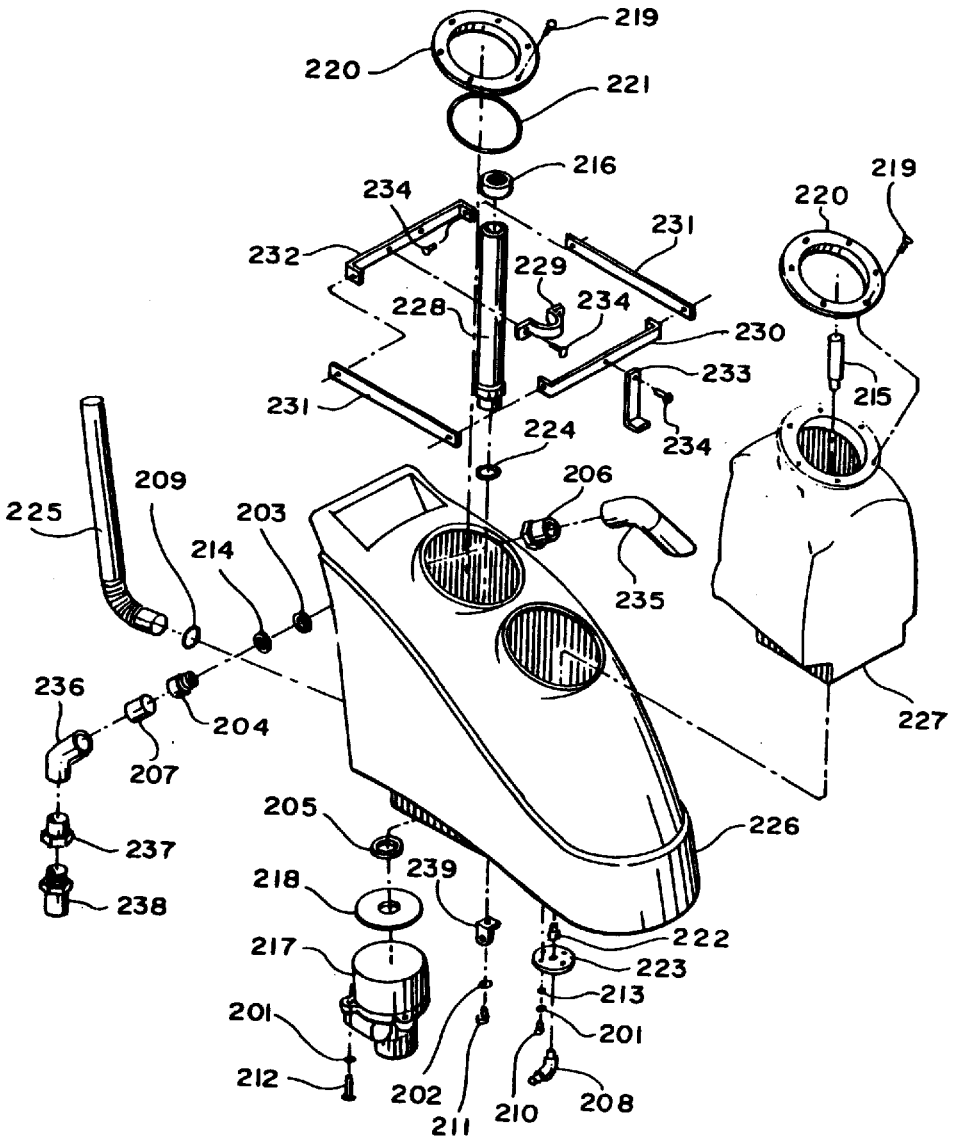
FIG. 5 is an exploded perspective view of the tank assembly.

The tank assembly 2 show in FIG. 5 comprises primarily the recovery tank 226 and the bladder 227. The only power component employed in the tank assembly 2 is the vacuum motor 217 which is secured to the tank 226 by means of bolts 212, washers 201 and gasket 218. Standpipe subassembly 228 secures to the tank 226 by means of nut 224. The vacuum motor 217 cooperates with the standpipe 228 to create a vacuum inside the tank 226. The drain hose 225 is secured by means of clamp hose 209 to recovery tank 226.

The recovery tank 226 has an access ring 220 secured to tank 226 by means of screws 219 and gasket 221. The bladder 227 has an access ring 220 that secures the top flange of bladder 227 to tank 226 by means of screws 219. Secured to the top of standpipe subassembly 228 is a screen filter 216. Clamp bracket 229 secures the standpipe subassembly 228 to brace 232 by means of bolts 234. Brace 232 secures to braces 231 by means of bolts 234. Braces 231 in turn secure to brace 230 by means of bolts 234. Brace 230 in turn secures to brace 233 by means of bolt 234. Inside bladder 227, screen filter 215 secures to fitting 222.

Figure 6:
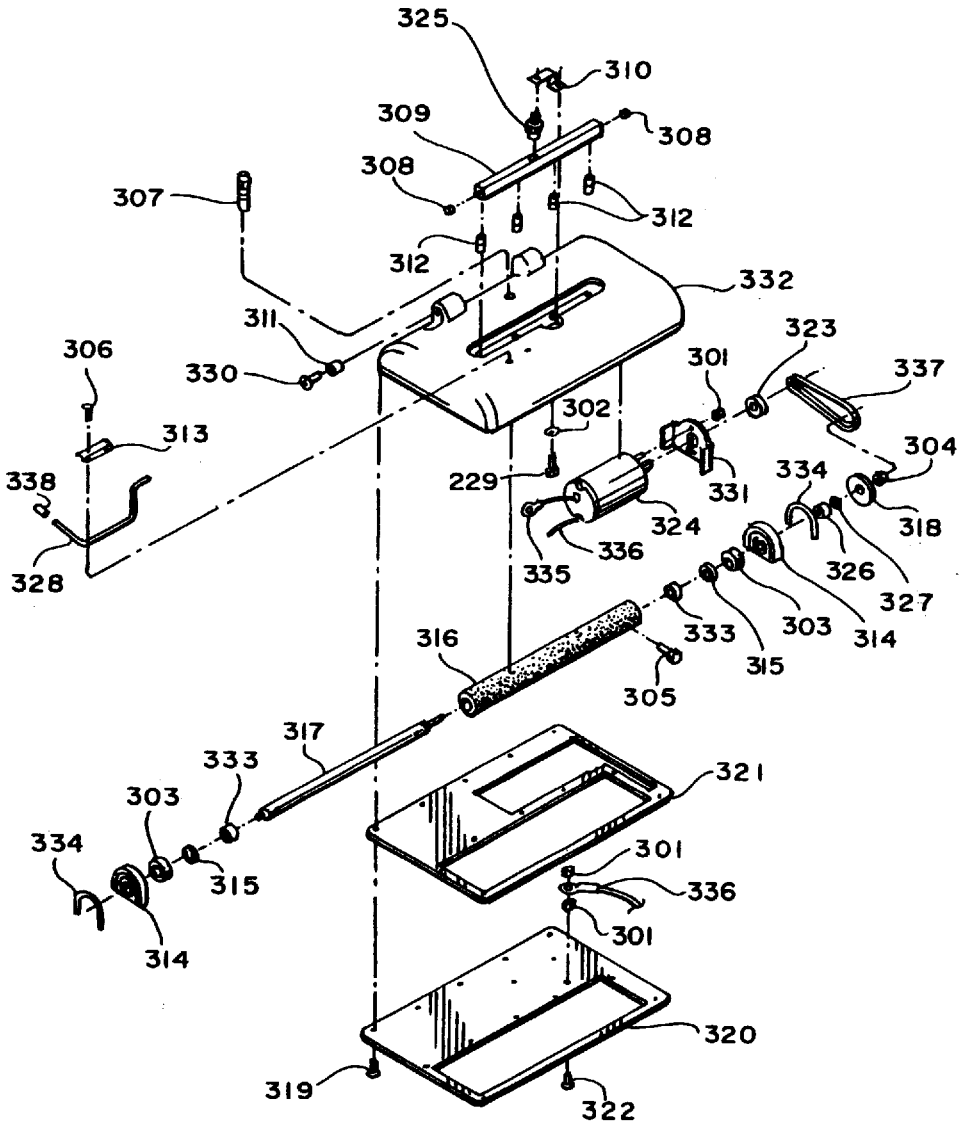
FIG. 6 is an exploded perspective view of the brush head and spray head assembly.

The brush head and spray assembly 3 is shown in exploded view in FIG. 6. There it will be seen that the shroud 332 is secured by means of bushings 311 and screws 330 depicted in FIG. 6 to bracket 126 depicted in FIG. 4. In FIG. 6, the manifold 309 with attached spray jets 312 is secured to the shroud 332 by means of bracket 310. Pipe plug fittings 308 are secured to the ends of the manifold 309. The electric motor 324 is secured to shroud 332 by means of mounting bracket 331 and nuts 301. The motor 324 is attached to pulley 323 which in turn drives belt 337, pulley 318, shaft 317 and brush 316. Brush 316 is secured to shaft 317 by means of bushings 333 and bolts 305. Shaft 317 is piloted by bearings 315 which in turn are secured to blocks 314 by means of a press fit. Blocks 314 secure the brush and mating components to shroud 332 by means of gasket 334, cover plate 320, cover plate gasket 321 and screws 319. Bearing seals 303 keep cleaning solution and debris from contacting bearings 315. Lever 328 is secured to shroud 332 by means of bracket 313 and screws 306. Lever 328 and plastic button 338 pivot the brush head assembly 3 between the retracted and application positions as described earlier.

Figure 7:
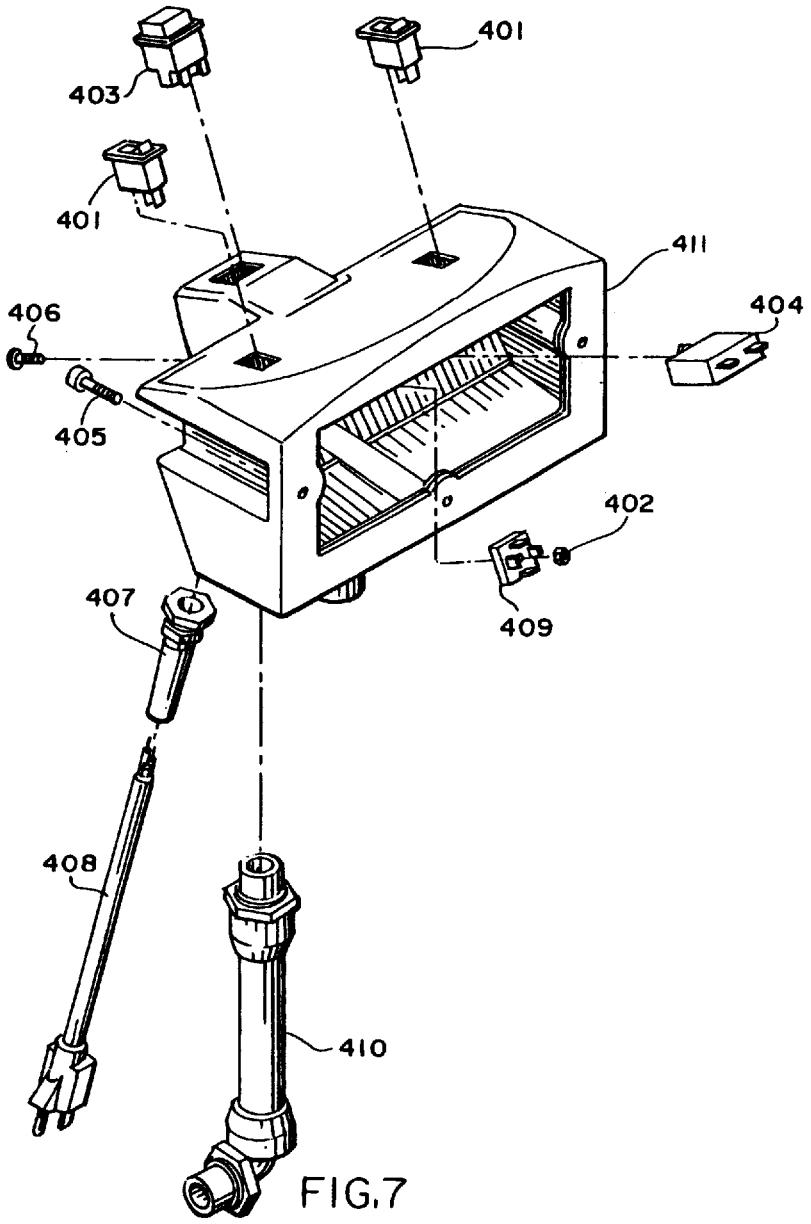
FIG. 7 is an exploded perspective view of the control panel assembly.

Turning now to FIG. 7, the control panel assembly 4 is shown in its exploded relationship. The assembly includes two rocker switches 401 which snap in the precut slots in the control housing 411. Momentary push button switch 403 is secured to housing 411 by means of a snap-in feature on the switch. The rectifier 409 and circuit breaker 404 are secured to the housing 411 by means of nut 402 and screw 406, respectively. The line cord 408 is secured to the housing 411 by means of strain relief 407. The control panel housing 411 is attached to the recovery tank 226 by means of screws 405. A wiring harness, extension cord, and belt clip cord holder are provided with each installation but not shown in the Figures.

Prior to discussing the center of gravity of the fluid in the combined tank 226 and asymmetrical bladder 227, the means of cleaning should be understood. The cleaner is pulled for cleaning, and then pushed while out of contact with the carpeting to a new position, usually spaced laterally from the original stroke, and then pulled again. In addition, it is important for the operator as well as the cleaning service and management of the premises being cleaned to know that the carpet will dry uniformly, and not necessarily contain 20% more moisture at one area of the carpet, than at other areas of the carpet. As a consequence, not only is it important to render consistent the engagement of the brush 316 with the carpet, but also render consistent the force and pressure relationship between the nozzle 137 and the carpet. This is done to the end that consistency, insofar as it can be achieved, will be achieved in the course of the totality of the cleaning cycle which contemplates three steps, not one; namely spray, brush, and vacuum.

Figure 8:
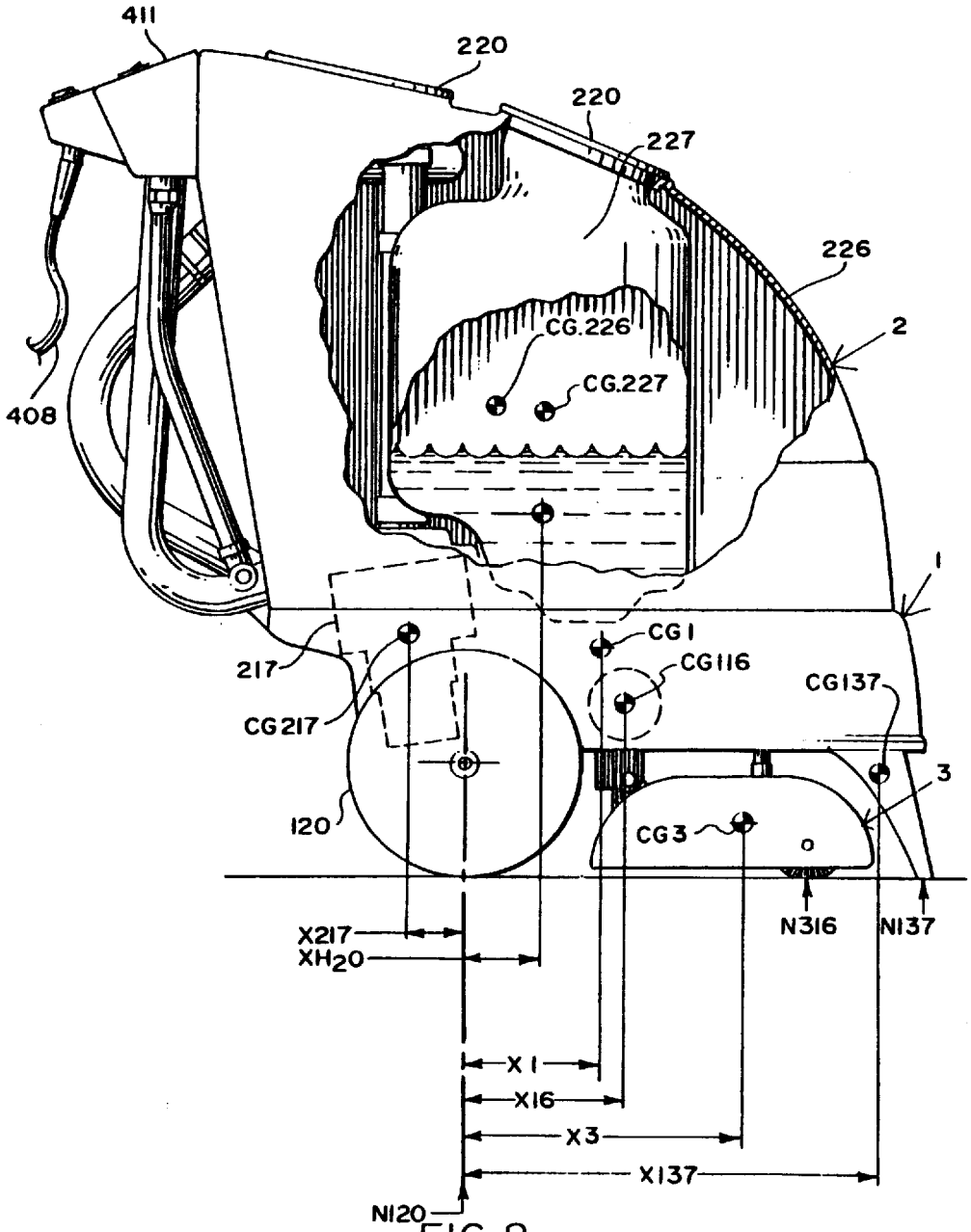
FIG. 8 is a diagrammatic view of the cleaner showing the points for calculating stability and the component and fluid centers of gravity.
Figure 9:
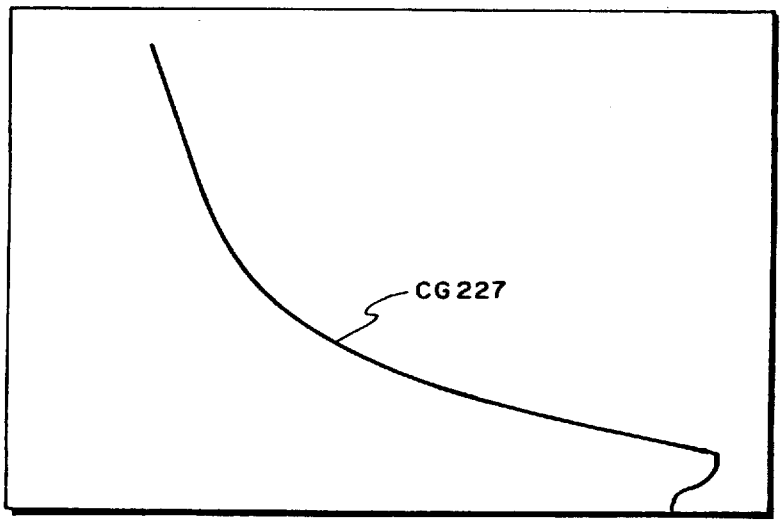
FIG. 9 shows the fluid center of gravity trace in a typical bladder.
Figure 10:
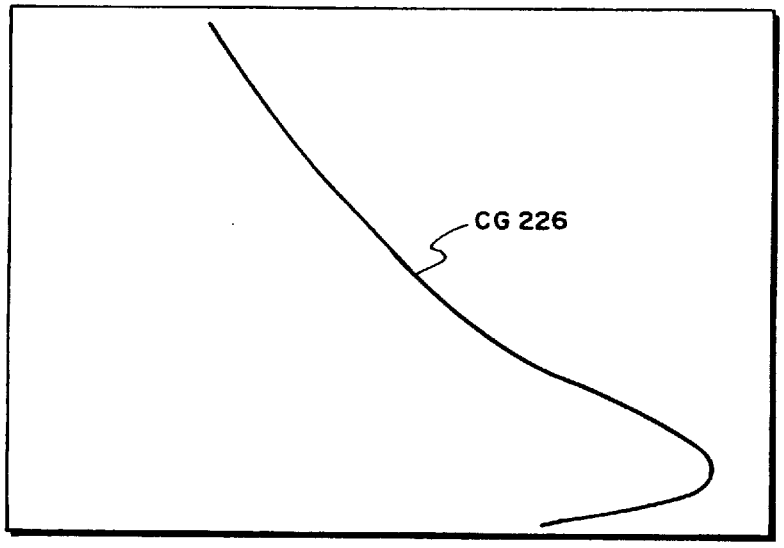
FIG. 10 shows the fluid center of gravity trace of the fluid in a typical recovery tank in the same unit of FIG. 9.

Consistent with the goal of constant loading of the nozzle 137, it will be seen that the cleaning fluid as shown in FIG. 8, as it is exhausted and as the clean fluid migrates from the bladder 227 into the soiled solution tank 226, the center of gravity of the combined weight of the fluid, in the event of fluid loss, shift in the direction from the wheels to the nozzle. The trace of the center of gravity of fluid in an eight gallon bladder is shown in FIG. 9. In FIG. 10 the trace of the center of gravity of the recovery fluid in the recovery tank is shown. The hydrodynamic moment load on the nozzle 137 is ideally designed to promote a consistent load on the nozzle from start-to-finish in the cycle. This is managed by the center of gravity design of the bladder in FIG. 9, supplemented by the design of the recovery tank as shown in FIG. 10.

Turning now to FIG. 8, a diagrammatical showing is made of the side elevation of the cleaning unit. The various elements including the bladder, tank, chassis and brush head assembly are shown separately, each of which has a center of gravity identified arbitrarily as CG. The CG of the tank is shown independent of the vacuum motor since the vacuum motor is an independent component. Alternatively, there could be a composite center of gravity of the tank and vacuum motor which would be somewhat shifted towards the axle.

Hereinafter, the terms equilibrium, normal force, moment, and center of gravity will be used. So that they are understood, equilibrium means in essence balance. Two fifty pound children at equal distances from the pivot of a teeter toter, in theory, are balanced. In short, the two children and the teeter toter are in equilibrium. A normal force means simply the weight or force applied to the unit perpendicular to a flat surface, in this instance, the carpeted floor. Torque is the force times the moment arm applied. Stated more simply, one pound of force on the end of a one foot wrench exerts a torque of one foot-pound. Finally, CG or center of gravity means that precise point in the volume of whatever the component may be about which the weight is essentially equal in all directions for the engineering application of imparted moments.

As shown in FIG. 8 various moment arms which effect the equilibrium of the unit with the three normal forces which are the normal force $N_{137}$ against the nozzle, the normal force $N_{316}$ against the brush, and the normal force $N_{120}$ against the wheel. The formula for determining the normal forces is such that the weight carried by the two wheels plus the force of the brush on the floor and the force of the nozzle on the floor equal the weight of the entire cleaning unit. This is essentially shown in FIG. 8.

The next calculation is based upon the proposition, for any amount of water in the bladder or the tank that the sum of the torques around the axle equals the sum of the torques around the axle of the parts less the moment or torque around the axle applied by the normal force on the brush less the moment or torque applied around the axle by the normal force on the nozzle plus the quantity of the weight of the water times the center of gravity of the water resulting in the torque of the water effected around the axle equals zero. Thus, (assuming that the axle is the axis around which moments are applied) the first formula reads:

Equation 1

$$(W_{H20})(X_{c.g.H20})=-(\text{sum of the torques effected by the components})+N_B(X_B)+N_n(X_n)$$

where:

$W_{H20}$ means total water weight $X_{c.g.H2O}$ means center of gravity of the water in the system (distance from the axle)

$N_B$ means normal force of the brush on the floor $X_B$ means the horizontal distance from the axle to where the brush touches the carpet $N_n$ means the normal static force of the nozzle on the carpet $X_n$ means the horizontal distance from the nozzle tip to the axle The goal is to keep the force ($N_n$) as constant as possible. Therefore for any optimal force on nozzle ($N_n$), the goal is to keep "$N_n$" as constant as possible:

Equation 2

$$N_n=\text{constant}=K_1$$

For even cleaning and scrubbing the brush force can be assumed to be constant:

Equation 3

$$N_B=\text{constant}-K_2$$

For the mechanical components designed, their effective mass and position are constant:

Equation 4

$$(\text{sum of torques applied by components})=\text{constant}=K_3$$

therefore,

Equation 5

$$(W_{H2O})(X_{c.g.H2O})=\text{Constant}$$

where:

$W_{H2O}$=weight of water in system $X_{c.g.H2O}$=position of center of gravity of the water in the system therefore, $$X_{c.gH_2O}=\frac{\text{Constant}}{W_{H_2O}}=\text{a function of the inverse of the weight of water.} \qquad \text{Equation 6}$$

FIG. 8 shows the center of gravity of the cleaning fluid for a partial volume of the cleaning fluid in the bladder. For any volume of fluid or water, the ideal design is to impart through the nozzle force on the carpet somewhere between 20 pounds and 30 pounds (depending on the size of the nozzle tip). The bladder and the tank geometries are designed such that any amount of water in either container causes the system to impart a designed force (Nn) on the floor from the nozzle which translates to a consistent ideal pressure on the tip of the nozzle.

Example: Bladder is full of water.

For any volume of water, the ideal design imparts to the nozzle a predetermined optimum force on the carpet. In this instance it is somewhere between twenty and thirty pounds. Thus, the bladder and the recovery water geometries are designed so that any amount of water in either of the two containers causes the system to impart the same ideal normal force on the carpet from the nozzle throughout the entire cleaning operation from full capacity of water in the bladder until it is depleted.

Example: Bladder and tank change quantities of fluid.

The center of gravity of the water in the bladder will differ from the center of gravity of water in the tank. Nonetheless, once the water levels in the bladder and the tank are equal due to equal air pressure above bodies of water, the combined center of gravity is the same as the center of gravity for the tank for the volume of water. The center of gravity of the tank follows the same formula as the bladder with the same general constant in Equation 6. The trace of these centers of gravity are shown respectively for the bladder in FIG. 9, and the recovery water tank in FIG. 10.

Summarizing, the best design optimizes the nozzle force so that it does not change substantially during operation from a full charge of fluid in the bladder until it is depleted. Also, for any given volume of cleaning water in the bladder greater than 25% of capacity which is two gallons in an eight gallon unit, the nozzle force throughout the operation will be at the ideal level. When the user wants to clean a small area with only three gallons rather than a full amount of eight gallons, the unit will operation efficiently with a consistent load on the nozzle based upon the moment of the fluid, and importantly in cooperation with the brush which is the subject of a constant load due to the fact that its loading is independent of any amount of fluid since it is a function of the weight of the brush head assembly on the brush. Moreover, the force required to tilt the unit by pressing the handle downwardly in order to shift it to another location remains essentially constant throughout the entire cleaning cycle. This permits the user or operator to gage the consistency of the cleaning. Also to be noted in the design as shown in FIGS. 1 and 8 is the fact that the recovery water, in considerable portion, is located toward the handle side of the axle and remote from the nozzle. This, in turn, contributes to the balancing of the weight on the nozzle throughout the entire cycle when fluid is transferred from the bladder onto the floor and then recovered into the recovery tank. By comparing FIGS. 9 and 10 it will be seen that the pattern of the centers of gravity of both the bladder fluid and the recovery tank fluid are comparable indicative of an empirical evaluation of the fluid movement.

To be noted in FIG. 8 the tank weight, depending upon the amount of water, is broken down into the orientation of the center of gravity, the zero distance being the axle. FIG. 9 shows the center of gravity trace of an eight gallon bladder. It will be seen that the center of gravity of the eight gallon bladder and the center of gravity of the recovery water weight of the tank shown in FIG. 10 are substantially coincident and constantly shifting forwardly over the nozzle as the amount of fluid is depleted and/or interchanged. As a consequence, the loading of the nozzle is essentially constant irrespective of the amount of fluid in the cleaner, irrespective of whether the fluid is recovery water or cleaning water.

The Method:

The method of the invention is directed to improving consistency in carpet cleaning. This method, in turn, is broken into two parts. The first part is the weight on the brush 324 which is scrubbing the fluid. The second part is the weight on the nozzle 137 which is extracting as much of the soiled fluid as possible from the carpet and returning the same into the tank 226 which surrounds the eccentric bladder 227. The normalizing of the weight of the brush is a determination of the weight of the brush head assembly, and that is it. Nine pounds has been found highly desirable. Normalizing the weight of the nozzle on the carpet is a function of the bladder design and the recovery tank design. This formula is set forth in detail above, and will not be repeated here since the formula describing the product is the same formula which is used in the method of developing the same and, of course, in the utilization of the subject carpet cleaner for uniform and efficient cleaning of the carpet.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. The method of forming a carpet cleaner having a tank assembly, including an outer reservoir tank, and an inner flexible bladder, means for rollingly supporting the carpet cleaner, and a brush assembly secured to the housing for driving an agitator, which agitator is in operative contact with the carpet, the step of proportioning the tank and the cleaning fluid container and precisely positioning the tank and container with respect to each other so that the combined center of gravity of the fresh solution and soiled solution migrate forwardly toward the nozzle as the solution is depleted from the cleaner, whereby a relatively constant loading is placed upon the agitator, and a relatively constant loading upon the vacuum nozzle, all to the end that there is a consistency in carpet cleansing throughout the entire cycle form the beginning when the cleaning fluid container has an initial amount of fluid, until the end of the cycle when the cleaning fluid container is substantially exhausted of its cleaning fluid.

2. The method of forming a carpet cleaner having a tank assembly, means for rollingly supporting the carpet cleaner, a tank in the cleaner for receiving recovery fluid, a cleaning fluid container within the tank for holding fresh fluid, and a brush assembly which is pivotally secured to the housing for driving an agitator which agitator is positionable to contact the carpet, the step of proportioning the tank and the cleaning fluid container and precisely positioning the tank and container with respect to each other so that the combined center of gravity of the fresh solution and soiled solution migrate forwardly toward the nozzle as the solution is depleted from the cleaner, whereby a relatively constant loading is place upon the vacuum nozzle, all to the end that there is a consistency in carpet cleansing throughout the entire cycle from the beginning when the cleaning fluid container has an initial amount of fluid, until the end of the cycle when the cleaning fluid container is substantially exhausted of its cleaning fluid.

* * * * *